US006527585B1

(12) United States Patent
Pannone

(10) Patent No.: US 6,527,585 B1
(45) Date of Patent: Mar. 4, 2003

(54) JUMPER CABLE SYSTEM

(76) Inventor: Robert Pannone, 177 Patterson Ave., Stratford, CT (US) 06614

( * ) Notice: Subject to any disclaimer, the term of this patent is extended or adjusted under 35 U.S.C. 154(b) by 0 days.

(21) Appl. No.: 09/523,787

(22) Filed: Mar. 13, 2000

(51) Int. Cl.[7] ..... H01R 11/00
(52) U.S. Cl. ..... 439/504
(58) Field of Search ..... 439/504, 502, 439/624, 620, 141

(56) References Cited

U.S. PATENT DOCUMENTS

| | | | | | |
|---|---|---|---|---|---|
| 3,967,133 | A | | 6/1976 | Bokern | |
| 4,136,381 | A | * | 1/1979 | Bone | 362/311 |
| 4,272,142 | A | * | 6/1981 | Zapf | 439/504 |
| 4,540,929 | A | | 9/1985 | Binkley | |
| 4,617,506 | A | | 10/1986 | Bogie et al. | |
| 4,721,479 | A | * | 1/1988 | Shuman | 439/503 |
| 4,726,786 | A | * | 2/1988 | Hill | 439/504 |
| 4,869,688 | A | * | 9/1989 | Merio | 439/504 |
| 4,885,524 | A | | 12/1989 | Wilburn | |
| 4,897,044 | A | * | 1/1990 | Rood | 439/504 |
| 4,906,205 | A | * | 3/1990 | Viles | 320/105 |
| 4,936,796 | A | * | 6/1990 | Anderson, Jr. | 439/620 |
| 4,969,834 | A | * | 11/1990 | Johnson | 439/141 |
| 5,599,204 | A | * | 2/1997 | Glassford | 439/502 |
| 5,635,817 | A | | 6/1997 | Shiska | |
| 5,936,381 | A | | 8/1999 | Suh | |
| 6,155,870 | A | * | 12/2000 | Valentine | 439/501 |

* cited by examiner

*Primary Examiner*—Lynn Field
*Assistant Examiner*—Brian S. Webb
(74) *Attorney, Agent, or Firm*—Bachman & LaPointe, P.C.

(57) ABSTRACT

The present invention relates to a jumper cable system for charging batteries on vehicles such as motorcycles, lawnmowers, lawn tractors, and small boats. The jumper cable system comprises a first cable having a pair of battery clips at one end and a male plug at a second end and a second cable having a pair of battery clips at one end and a female socket at a second end. The male plug on the first cable is sized to fit within an electrical outlet such as an automobile cigarette lighter socket. The female socket on the second cable is sized to mate with the male plug and form an electrical connection therebetween. The cable jumper system of the present invention is versatile since it can be used either by inserting the male plug of the first cable into an electrical outlet and connecting the battery clips to the terminals on the battery to be charged or by mating the first and second cables and connecting the battery clips on the cables to respective batteries.

13 Claims, 6 Drawing Sheets

JUMPER CABLE SYSTEM

BACKGROUND OF THE INVENTION

The present invention relates to a jumper cable system for charging batteries on motorcycles, lawnmowers, boats, lawn tractors, and the like.

It sometimes happens that an engine on a vehicle will not start because of a shortage of electricity in the vehicle's battery. When this happens, the operator of the vehicle typically uses jumper cables to draw power from another source of electricity to start the vehicle and charge the weakened battery in the vehicle. Over the years, there have been a number of different available jumper cable systems.

U.S. Pat. No. 4,272,142 to Zapf illustrates a jumper cable comprised of first and second electrical cables which each have a pair of electrical connector clamps on one end thereof. An electrical coupling is positioned on the other end of the two electrical cables with the connectors adapted to be secured to each other at approximately the midpoint between the clamps. A polarity indicator circuit is located within each connector and is comprised of diodes and separate and differently colored lights to visually verify that the appropriate clamps have been secured to the battery being charged.

U.S. Pat. No. 3,967,133 to Bokern illustrates a power source for use in remote locations which can be operated off of an automobile battery system. The power source includes means for distinguishing between different voltages and includes means to indicate when power has been reduced from the power source or battery below a safe level for taking additional power therefrom.

The device also includes means for preventing a polarity reversal from causing damage. It further includes adapter means by which the subject power source can be plugged into a receptacle such as a cigarette lighter receptacle on the dashboard of an automobile.

U.S. Pat. No. 5,936,381 illustrates a charging apparatus for car batteries. The charging apparatus includes a switch mode power supply to generate additional voltage and a built-in maximum current limiting circuit and voltage regulating circuit.

The apparatus further includes a pair of cigar jacks adapted to be inserted into cigarette lighter receptacles in a pair of vehicles. U.S. Pat. No. 4,617,506 to Bogie et al. illustrates a similar system which also uses cigar jacks to plug into cigarette lighter receptacles.

Still other vehicle charging systems are illustrated in U.S. Pat. No. 4,540,929 to Binkley; U.S. Pat. No. 4,885,524 to Wilburn; and U.S. Pat. No. 5,635,817 to Shiska.

None of these battery charging systems are particularly useful with smaller vehicles such as motorcycles, lawnmowers, lawn tractors, small boats and the like.

SUMMARY OF THE INVENTION

Accordingly, it is an object of the present invention to provide a jumper cable system which has utility with smaller vehicles.

It is a further object of the present invention to provide a jumper cable system which is compact and easy to store.

It is yet a further object of the present invention to provide a jumper cable system which is versatile so that it can be used with a variety of different sources of electrical power.

The foregoing objects are attained by the jumper cable system of the present invention.

In accordance with the present invention, a jumper cable system for charging batteries comprises a first cable having a pair of battery clips at one end and a male plug at a second end and a second cable having a pair of battery clips at one end and a female socket at a second end. The male plug on the first cable is sized to fit within an electrical outlet such as an automobile cigarette lighter socket. The female socket on the second cable is sized to mate with the male plug and form an electrical connection therebetween. The jumper cable system is versatile since it can be used by inserting the male plug of the first cable into an electrical outlet and connecting the battery clips to the terminals on the battery to be charged. Alternatively, the jumper cable system can be used by mating the first and second cables via the male plug and the female socket and connecting the battery clips on one cable to a source of electrical power such as a charged 12V battery and the battery clips on the second cable to a weak battery to be charged.

Other details of the jumper cable system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
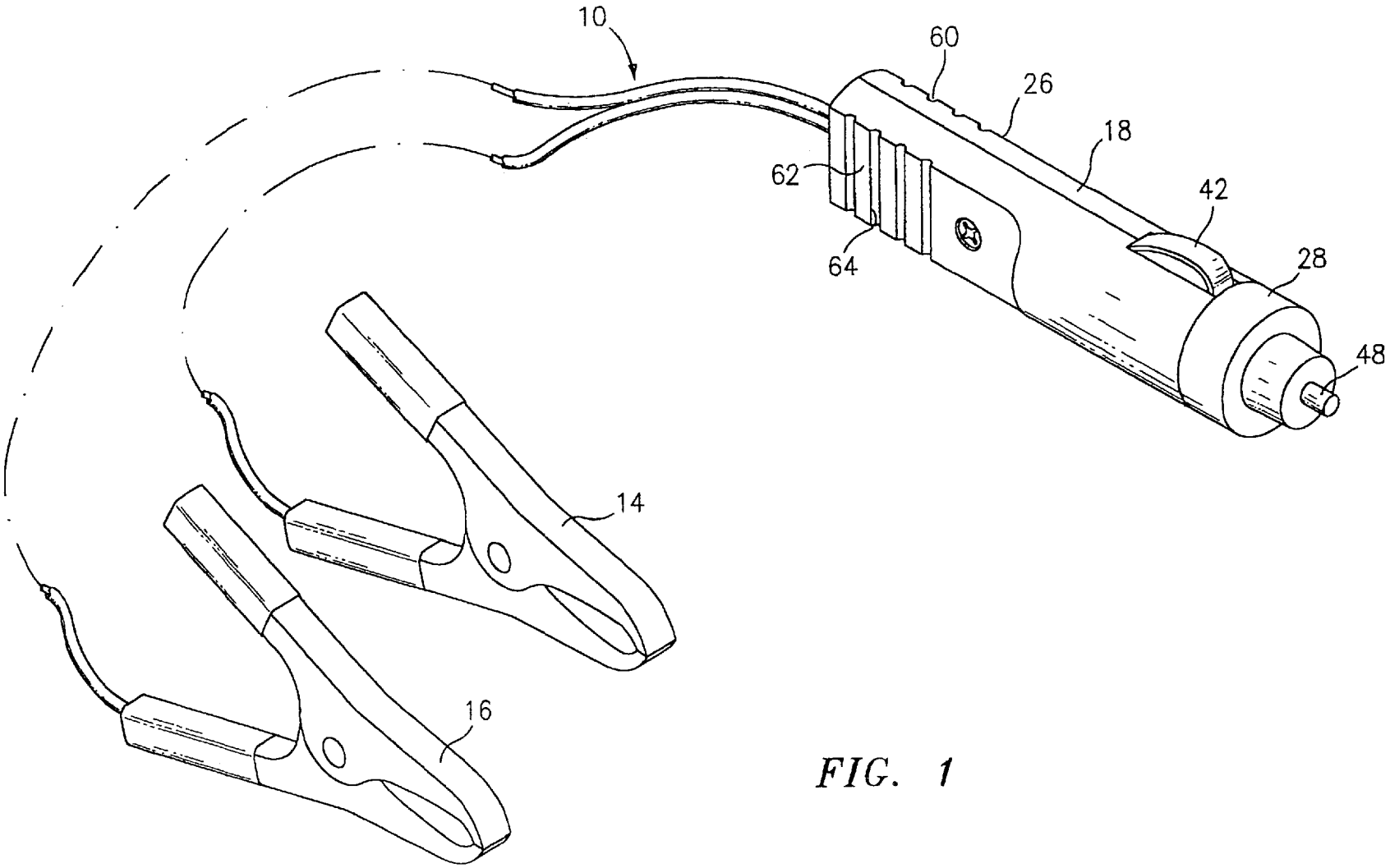
FIG. 1 is a perspective view of a first cable forming part of the jumper cable system of the present invention.
Figure 2:
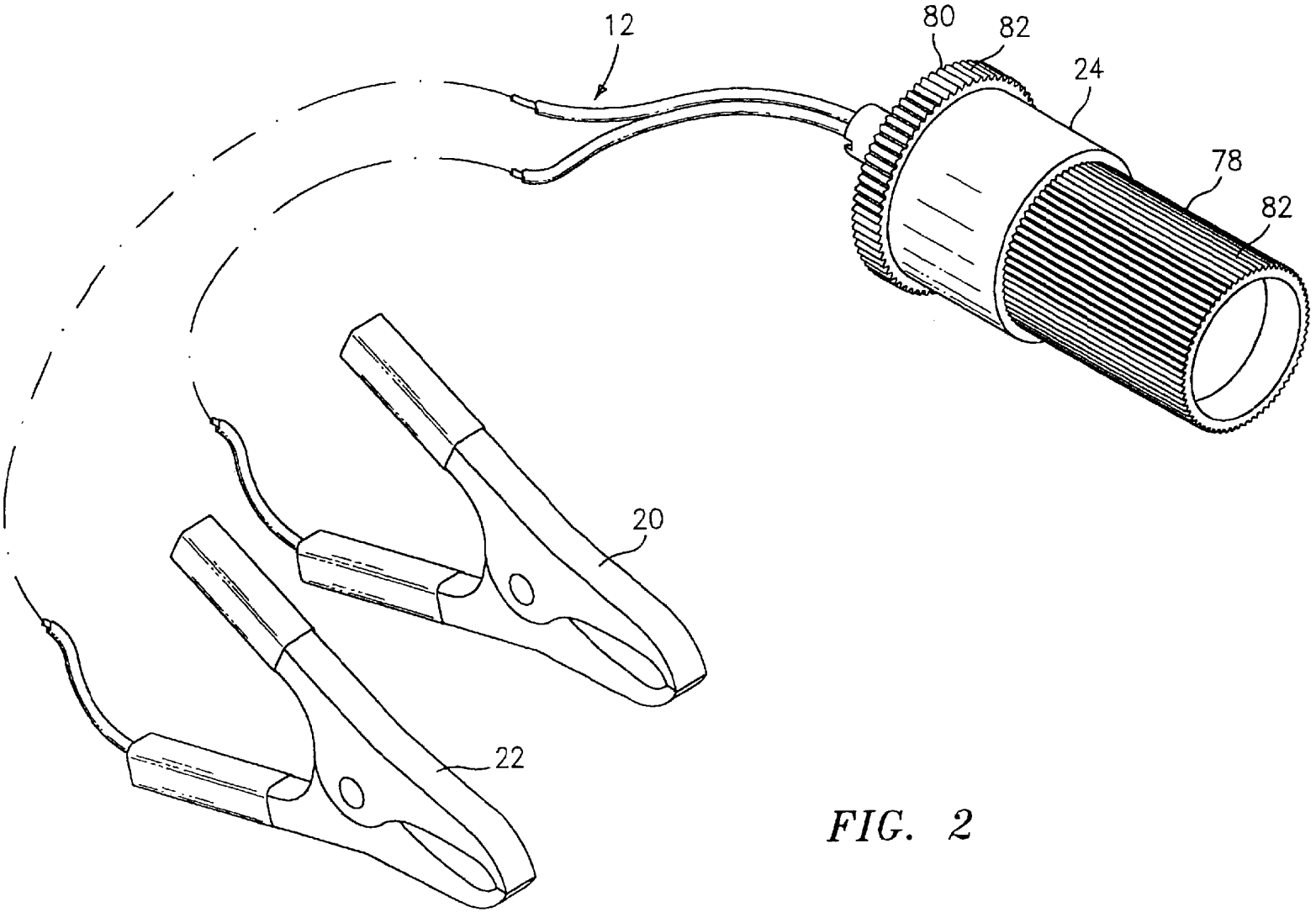
FIG. 2 is a perspective view of a second cable forming part of the jumper cable system of the present invention.

Referring now to the drawings, FIGS. 1 and 2 illustrate the two cables 10 and 12 which form the jumper cable system of the present invention. The cable 10 has a pair of terminal clamps or battery clips 14 and 16 located at a first end and a male plug 18 located at a second end, which plug is sized to fit within and be used with an electrical outlet such as an automobile cigarette lighter socket. The cable 12 also has a pair of terminal clamps or battery clips 20 and 22 at one end. The cable 12 differs from the cable 10 in that its second end has female socket 24 which has a bore that is sized to receive the male plug 18. In one mode of using the jumper cable system of the present invention, the female socket 24 is mated to the male plug 18 to form an electrical connection therebetween.

Figure 3:
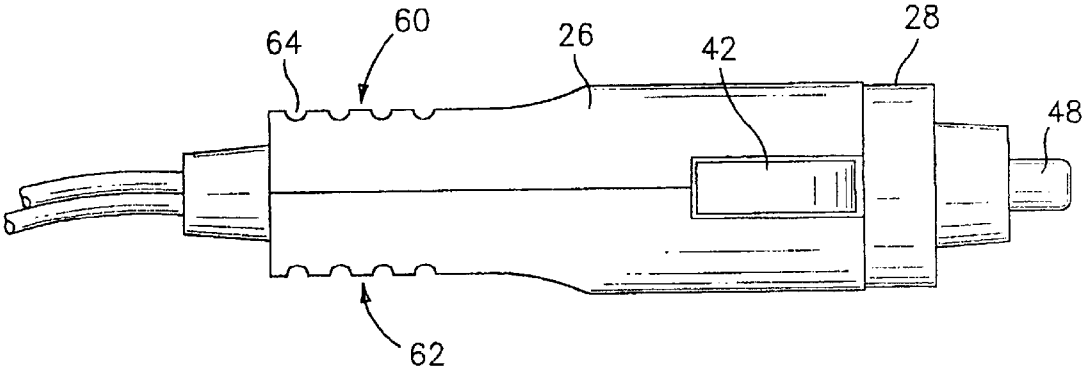
FIG. 3 is a top view of a male plug portion of the first cable.
Figure 4:
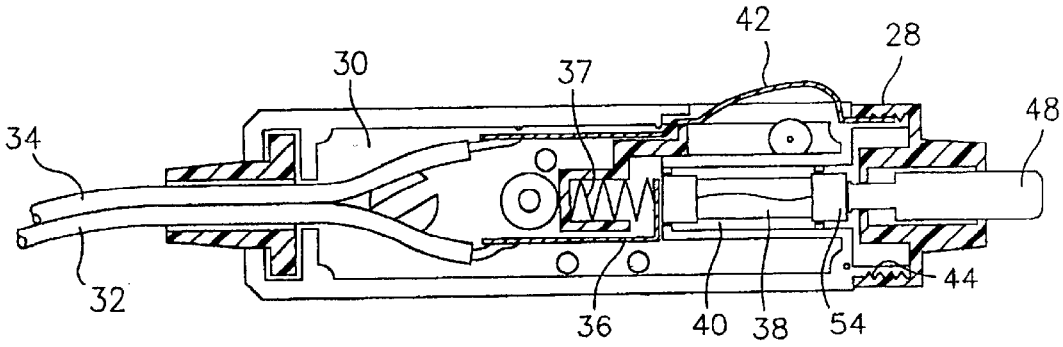
FIG. 4 is a sectional view of the main body portion of the male plug of FIG. 3.
Figure 5:
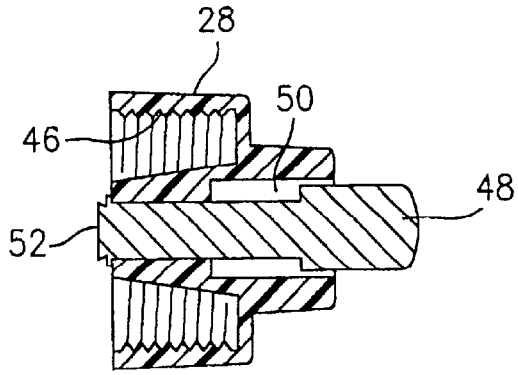
FIG. 5 is a sectional view of the cap of the male plug of FIG. 3.

Referring now to FIGS. 3–5, the male plug 18 has a main body portion 26 and a removable cap 28. The main body portion 26 includes a channel 30 through which wires 32 and 34 enter the main body portion. First ends of the wires 32 and 34 are respectively connected to the battery clips 14 and 16. The wire 32 is connected at its second end to an electrical contact 36 positioned at an end of the channel 30. The contact 36 is held in electrical contact with a fuse 38 positioned within a bore 40 in the main body portion 26 by a spring 37 fixed secured within the main body portion. The second end of the wire 34 is connected to an arcuately shaped, spring contact member 42. The spring contact member 42 may be mounted or attached to the main body portion 26 in any desired manner known in the art. Further, the contacts 36 and 42 may be formed from any suitable electrically conductive material known in the art.

The tip portion 44 of the main body portion 26 is threaded so as to facilitate placement of the removable cap 28. As shown in FIG. 5, the cap 28 has a threaded portion 46 which mates with the threaded tip portion 44 of the main body portion 26. This enables the cap 28 to be easily removed should it be necessary to replace the fuse 38. The cap 28 includes a metal pin 48 which also acts as an electrical contact. The metal pin 48 slides within a bore 50 in the cap 28 so as to insure good contact between its end 52 and the end surface 54 of the fuse 38.

As shown in FIG. 3, the main body portion 26 of the male plug 18 has two flattened portions 60 and 62. The flattened portions 60 and 62 are designed to accommodate the finger tips of a user. Each portion 60 and 62 is provided with a series of grooves 64 to insure good frictional contact between the user's fingers and the male plug 18 when the male plug is to be inserted into, or withdrawn from, an electrical outlet 58 or the female socket 24.

Figure 7:
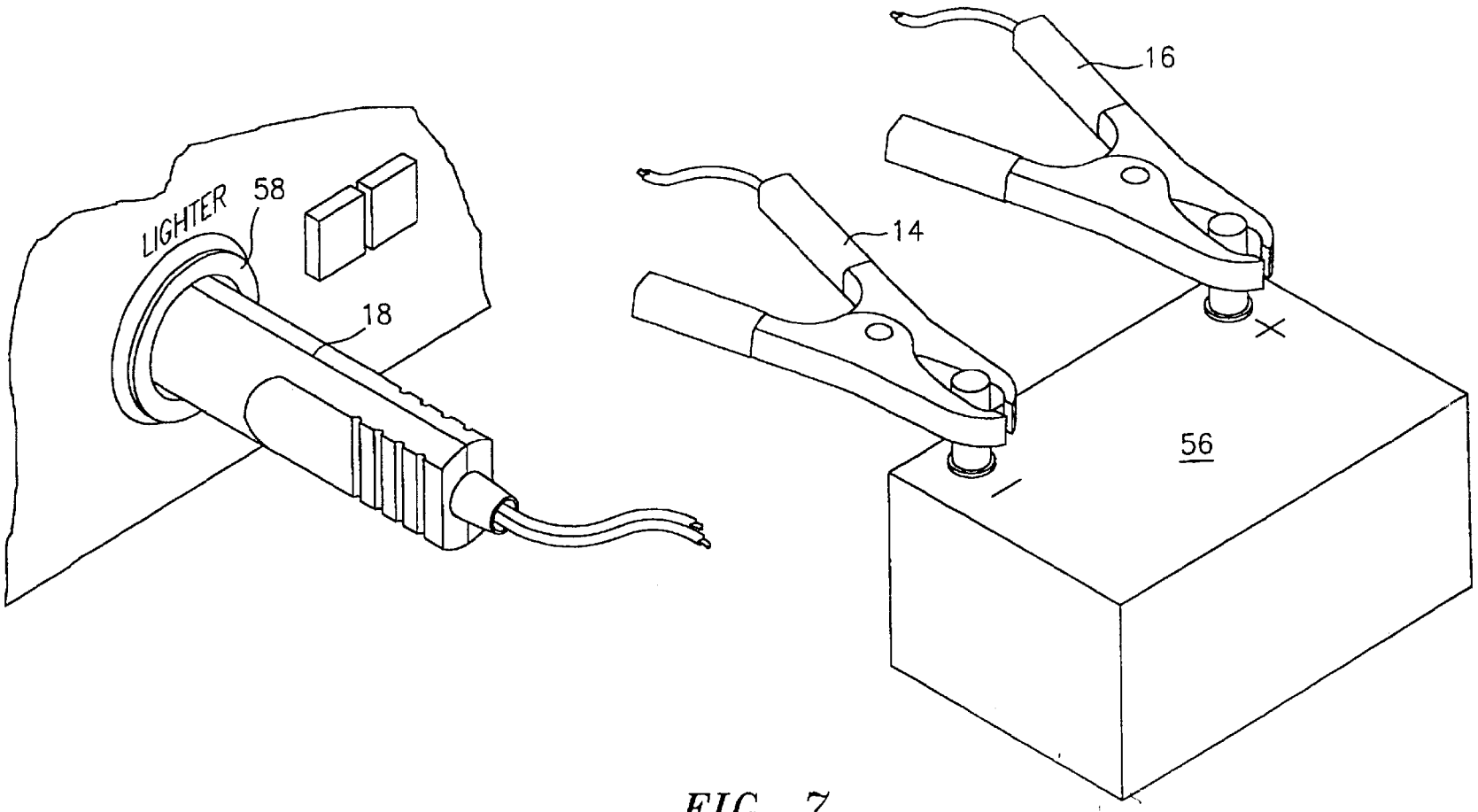
FIG. 7 is a perspective view of the first cable joined to an electrical outlet and to a battery to be charged.

If desired, the cable 10 may be used by itself to charge a weakened battery 56. As shown in FIG. 7, the male plug 18 may be inserted into an electrical outlet 58, such as an automobile cigarette lighter socket, which is connected to a source of power (not shown). The battery clips 14 and 16 may then be respectively connected to the terminals of the weakened battery 56 so as to charge the battery 56 and/or start a vehicle or device attached to the battery 56.

Figure 6:
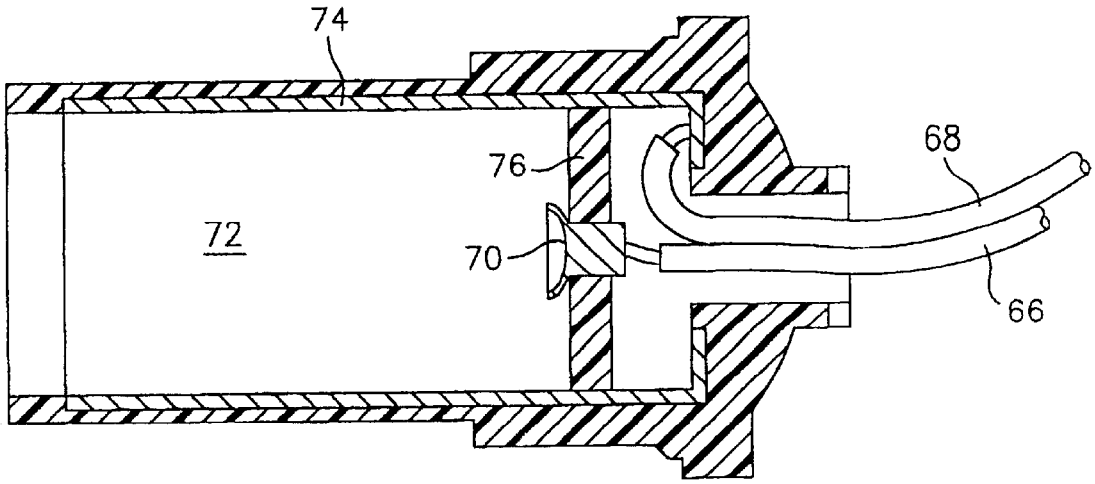
FIG. 6 is a sectional view of a female socket portion on the second cable.

Referring now to FIG. 6, as previously mentioned, the second cable 12 has battery clips 20 and 22 and a female socket 24. The cable 12 also has two wires 66 and 68 which extend between the battery clips 20 and 22 and the female socket 24. A first end of the wire 66 is connected to the battery clip 20, while a first end of the wire 68 is connected to the battery clip 22. A second end of the wire 66 is connected to an electrical contact 70 centrally located within an end of a bore 72 in the female socket 24. The second end of the wire 68 is connected to a cylinder 74 formed from an electrically conductive material. The cylinder 74 may be attached to the walls of the bore 72 in any suitable manner, such as by an adhesive. In order to insulate the contact 70 from the electrical conductive cylinder 74, a disk 76 formed from an electrically non-conductive material, such as plastic, surrounds the contact 70. The disk 76 may be held in place in the bore 72 by an adhesive material or the like. As can be seen from FIG. 6, the end of the bore 72 remote from the contact 70 is open.

As can be seen from the drawings, portions 78 and 80 of the female socket 24 have a series of raised or ribbed portions 82. The raised or ribbed portions 82 are intended to increase the friction between a user's fingers and the female socket 24 so that a user can more easily grip the socket.

The bore 72 in the female socket 24 is sized so that the end of the male plug 18 can be inserted therein and so that the spring contact member 42 can contact the cylindrical contact 74 and the pin 48 can contact the electrical contact 70. In this way, a good electrical connection can be created between the male plug 18 and the female socket 24.

Figure 8:
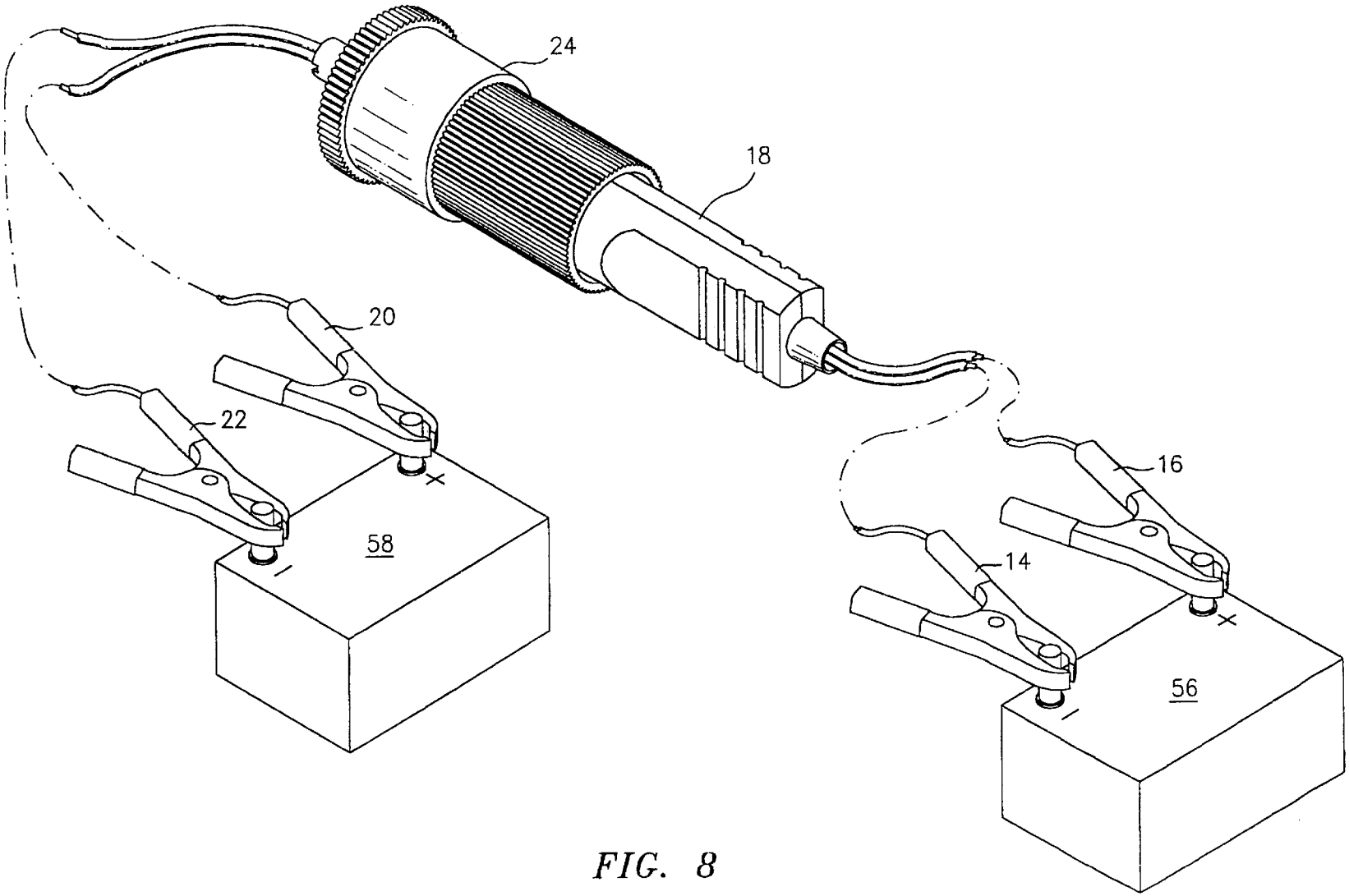
FIG. 8 is a perspective view of the first cable joined to the second cable with the terminal clamps on each cable connected to a respective battery.

As shown in FIG. 8, the cable 10 may also be used in conjunction with cable 12 to draw power from a source such as battery 84 and either charge a weak battery 56 or jump start the vehicle or device attached to the battery 56.

As can be seen from FIGS. 1 and 2, in a preferred embodiment of the jumper cable system of the present invention, the wires 32 and 34 have a length greater than the wires 66 and 68. For example, wires 32 and 34 may have an eight foot length, while the wires 66 and 68 have a shorter length.

The use of a replaceable fuse 38 in the jumper cable system of the present invention is advantageous in that it prevents electrical problems from occurring. Should the fuse 38 burn out, it can be easily replaced by merely screwing the end cap 28 off the male plug 18, taking out the burned out fuse, inserting a new fuse, and screwing the cap back onto the male plug.

The jumper cable system of the present invention is extremely compact and may be stored in small compartments. Further, it can be used to jump start or charge batteries on small vehicles, such as motorcycles, lawn mowers, lawn tractors, small boats and the like, or on other types of electrical devices. To charge a battery from an electrical outlet such as a car's cigarette lighter, one need only insert the male plug 18 into the cigarette lighter socket and connect the battery clips 14 and 16 to the terminals on the battery to be charged. Alternatively, a user can charge a battery on one small vehicle or device from a battery on another vehicle or device by inserting the male plug 18 into the female socket 24, connecting the battery clips 14 and 16 or 20 and 22 to the terminals on the good battery, and connecting the other pair of battery clips to the terminals on the weak battery.

In a preferred embodiment of the present invention, one of the battery clips 14 and 16 is coded red and the other coded green. Similarly, one of the battery clips 20 and 22 is coded red and the other coded green.

When cold weather approaches and motorcyclists anticipate retiring their bikes for the winter, they put them into a sort of suspended animation. That is, they, among other things, physically remove the battery from the motorcycle and hook it up to a trickle charger. The trickle charger emits a low-level charge that keeps the battery charged over the winter. There are several reasons why trickle charging is undesirable. First, trickle chargers are single purpose. Second, they are expensive. Third, because the battery has to be physically removed, the motorcycle cannot be readily ridden when sudden, unexpected sessions of warm weather occur. True, the battery can always be re-installed, but it is often inconvenient enough to be deterrent to quick rides. The cables of the present invention eliminate all of the above. That is, they are multi-purpose acting as both jumper cables and trickle charger. Also, they are less expensive than trickle chargers. Additionally, by hooking them up to the bike's battery (while it is on the motorcycle) a few minutes a month, the bike is always ready for warm days.

It is apparent that there has been provided in accordance with the present invention a jumper cable system which fully satisfices the means, objects and advantages set forth hereinbefore. While the present invention as been described in the context of specific embodiments thereof, other variations, alternatives, and modifications will become apparent to those skilled in the art after reading the foregoing description. Thus, it is intended to embrace those variations, alternatives, and modifications which fall within the broad scope of the appended claims.

What is claimed is:

1. A jumper cable system for charging batteries which comprises:

a first cable having a pair of battery clips at one end and a male plug at a second end;

said male plug being sized to fit within an electrical outlet;

a second cable having a pair of battery clips at one end and a female socket at said second end;

said female socket being sized to mate with said male plug and form an electrical connection therebetween; and said male plug being sized to fit within an automobile's cigarette lighter socket, wherein a first battery to be charged may be electrically connected to a second battery via said male plug and said electrical outlet or via said electrical connection between said male plug and said female socket.

2. The jumper cable system of claim 1, wherein each of said pairs of battery clips has a red coded battery clip for mating with a red terminal on a respective battery and a green coded battery clip for mating with a green terminal on a respective battery.

3. A jumper cable system for charging batteries which comprises:

a first cable having a pair of battery clips at one end and a male plug at a second end;

said male plug being sized to fit within an electrical outlet;

a second cable having a pair of battery clips at one end and a female socket at said second end;

said female socket being sized to mate with said male plug and form an electrical connection therebetween; and said male plug having a pin which acts as a first electrical contact and a spring member which acts as a second electrical contact.

4. The jumper cable system of claim 3, wherein said male plug includes a removable cap and said pin is slidably mounted within said removable cap.

5. The jumper cable system of claim 4, wherein said male plug includes a main body with an interior bore for housing a replaceable fuse which is in electrical contact with said pin.

6. The jumper cable system of claim 5, wherein access to said replaceable fuse is gained via said removable cap.

7. The jumper cable system of claim 6, wherein said removable cap is connected to said main body of said male plug via a threaded connection.

8. The jumper cable system of claim 3, wherein said female socket includes a contact member with an open ended bore for receiving a tip of said pin and an electrically conductive interior surface for contacting said spring member.

9. The jumper cable system of claim 1, wherein said male plug member includes two flattened portions for facilitating insertion and removal of said male plug into said electrical outlet or said female socket.

10. The jumper cable system of claim 9, wherein each of said flattened portions has a plurality grooves for enhancing frictional contact between a user's fingers and said male plug.

11. The jumper cable system of claim 1, wherein said female socket has a cylindrical housing and wherein exterior portions of said housing are ribbed to increase frictional contact between said housing and a user's fingers.

12. The jumper cable system of claim 1, wherein said first and second cables have different lengths.

13. The jumper cable system of claim 12, wherein said first cable has a length greater than the length of said second cable.

* * * * *